US011767695B2

(12) United States Patent
Lin

(10) Patent No.: US 11,767,695 B2
(45) Date of Patent: Sep. 26, 2023

(54) RESISTANCE HINGE

(71) Applicant: Foxlink Image Technology Co., Ltd., New Taipei (TW)

(72) Inventor: Ming Wei Lin, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 17/717,361

(22) Filed: Apr. 11, 2022

(65) Prior Publication Data

US 2023/0009351 A1 Jan. 12, 2023

(30) Foreign Application Priority Data

Jul. 8, 2021 (CN) ..... 202121568343.X

(51) Int. Cl.
*E05D 11/08* (2006.01)
*E05D 3/12* (2006.01)

(52) U.S. Cl.
CPC ..... *E05D 11/084* (2013.01); *E05D 3/122* (2013.01); *E05D 2011/085* (2013.01)

(58) Field of Classification Search
CPC ..... G06F 1/1681; G06F 1/1616; E05Y 2900/606; E05Y 2201/26; H04M 1/0216; E05D 11/082; E05D 11/084; E05D 11/085; E05D 3/02; E05D 3/122; E05D 5/14; E05D 2005/145; E05D 2011/085; F16C 11/04
See application file for complete search history.

(56) References Cited

U.S. PATENT DOCUMENTS 4,960,256 A * 10/1990 Chihara ..... G06F 1/1681 16/361
5,018,244 A * 5/1991 Hino ..... G06F 1/1616 16/337
5,197,704 A * 3/1993 Kitamura ..... G06F 1/1616 16/342
5,464,083 A * 11/1995 Arnold ..... F16D 7/022 16/337
5,771,539 A * 6/1998 Wahlstedt ..... F16D 7/022 16/342
8,186,638 B2 * 5/2012 Nishida ..... B60R 7/08 224/313
10,597,924 B2 * 3/2020 Hu ..... E05D 11/1014
2002/0170143 A1 * 11/2002 Vitry ..... E05C 17/38 16/231
2003/0208882 A1 * 11/2003 Kim ..... E05F 5/00 16/354
2004/0049883 A1 * 3/2004 Huang ..... G06F 1/1616 16/295
2018/0245387 A1 * 8/2018 Suzuki ..... F16F 7/06
2019/0003222 A1 * 1/2019 Taguchi ..... G03G 21/1619
2020/0332580 A1 * 10/2020 Homner ..... E05D 11/0054

* cited by examiner

*Primary Examiner* — Chuck Y Mah
(74) *Attorney, Agent, or Firm* — LIN & ASSOCIATES INTELLECTUAL PROPERTY, INC.

(57) ABSTRACT

A resistance hinge includes a first hinge bracket, a fixing shaft fastened in the first hinge bracket, a locating holder surrounding the fixing shaft, a friction part, a second hinge bracket and a transmission module. The friction part is formed in a hollow cylinder shape and surrounds the locating holder together with the fixing shaft. The second hinge bracket is pivotally mounted on the first hinge bracket. The transmission module is connected between the friction part and the second hinge bracket.

12 Claims, 6 Drawing Sheets

RESISTANCE HINGE

CROSS-REFERENCE TO RELATED APPLICATION

The present application is based on, and claims priority from, China Patent Application No. 202121568343.X, filed Jul. 8, 2021, the disclosure of which is hereby incorporated by reference herein in its entirety.

BACKGROUND OF THE INVENTION

1. Field of the Invention

The present invention generally relates to a resistance hinge, and more particularly to a resistance hinge which has a stable resistance force, and the resistance force of the resistance hinge is adjusted easily.

2. The Related Art

Referring to FIG. 6, a diagram of a conventional resistance hinge is shown in FIG. 6. The conventional resistance hinge includes a cam 60 and an elastic component 61. The elastic component 61 pushes against the cam 60 to exert a resistance force on the conventional resistance hinge. Because a curve surface model of the cam 60 is adjusted, when the conventional resistance hinge is opened, the conventional resistance hinge is closed, or the conventional resistance hinge is opened to a specific angle, the conventional resistance hinge has different resistance forces at different positions.

However, after the curve surface model of the cam 60 of the conventional resistance hinge is abraded, the curve surface model of the cam 60 is changed, the resistance force of the conventional resistance hinge is changed, so that the resistance force of the conventional resistance hinge is unstable. Moreover, if the resistance force of the conventional resistance hinge needs changing, the cam 60 needs redesigning and producing, so the different cams 60 are designed to provide the different resistance forces for the conventional resistance hinge, and the different cams 60 is unable to be exchanged in use.

Therefore, it is necessary to provide an innovative resistance hinge which has a stable resistance force, and the resistance force of the innovative resistance hinge is adjusted easily.

SUMMARY OF THE INVENTION

An object of the present invention is to provide a resistance hinge which has a stable resistance force, and the resistance force of the resistance hinge is adjusted easily. The resistance hinge includes a first hinge bracket, a fixing shaft fastened in the first hinge bracket, a locating holder surrounding the fixing shaft, a friction part, a second hinge bracket and a transmission module. The friction part is formed in a hollow cylinder shape and surrounds the locating holder together with the fixing shaft. The second hinge bracket is pivotally mounted on the first hinge bracket. The transmission module is connected between the friction part and the second hinge bracket.

Another object of the present invention is to provide a resistance hinge. The resistance hinge includes a first hinge bracket, a fixing shaft fastened in the first hinge bracket, a locating holder surrounding the fixing shaft, a friction part, a second hinge bracket, a transmission module and a transmission shaft. The friction part is formed in a hollow cylinder shape and surrounds the locating holder together with the fixing shaft. The second hinge bracket is pivotally mounted on the first hinge bracket. The transmission module is connected between the friction part and the second hinge bracket. The transmission module includes a curve rack, a transmission gear and a worm. The curve rack is arranged at a lower portion of one side of the second hinge bracket. The transmission gear is hollow. The transmission gear is pivotally mounted in the first hinge bracket. The transmission gear is engaged with the curve rack. The worm surrounds the locating holder. The worm is engaged with the transmission gear. The transmission gear is mounted around the transmission shaft.

Another object of the present invention is to provide a resistance hinge. The resistance hinge includes a first hinge bracket, a fixing shaft fastened in the first hinge bracket, a locating holder surrounding the fixing shaft, a friction part, a second hinge bracket, a transmission module and a transmission shaft. The friction part includes a first torsion spring and a second torsion spring. The first torsion spring and the second torsion spring both surround the locating holder together with the fixing shaft. The second hinge bracket is pivotally mounted on the first hinge bracket. The transmission module is connected between the friction part and the second hinge bracket. The transmission module includes a curve rack, a transmission gear and a worm. The curve rack is arranged at a lower portion of one side of the second hinge bracket. The transmission gear is hollow. The transmission gear is pivotally mounted in the first hinge bracket. The transmission gear is engaged with the curve rack. The worm surrounds the locating holder. The worm is engaged with the transmission gear. The transmission gear is mounted around the transmission shaft.

As described above, when the second hinge bracket of the resistance hinge is opened from the first hinge bracket or closed to the first hinge bracket, a whole resistance force of the friction part provided for the second hinge bracket is adjusted by virtue of adjusting a length proportion of the first torsion spring and a length proportion of the second torsion spring of the friction part. As a result, the resistance hinge has a stable resistance force, and the resistance force of the resistance hinge is adjusted easily.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
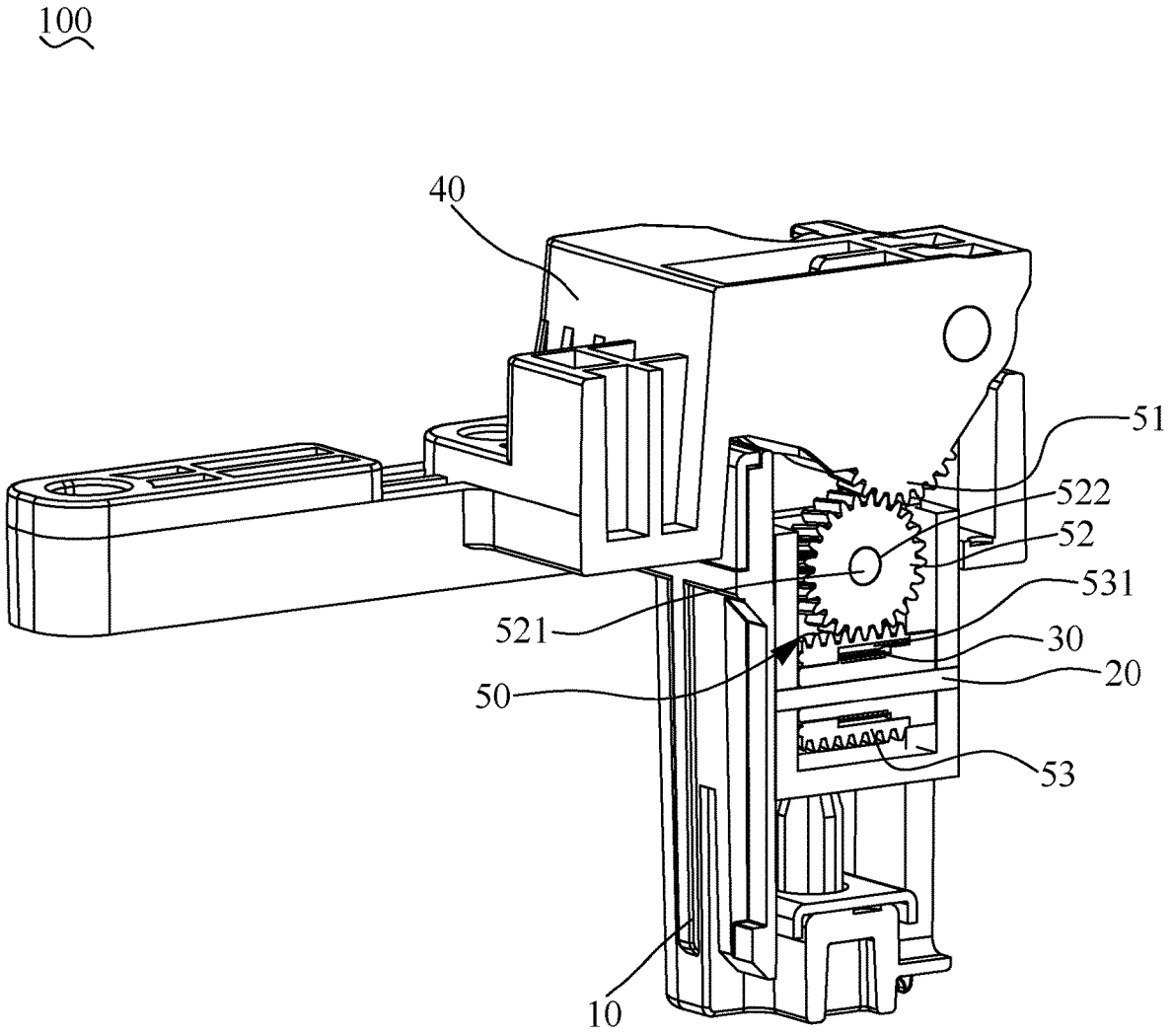
FIG. 1 is a partially cross-sectional view of a resistance hinge in accordance with a preferred embodiment of the present invention.
Figure 2:
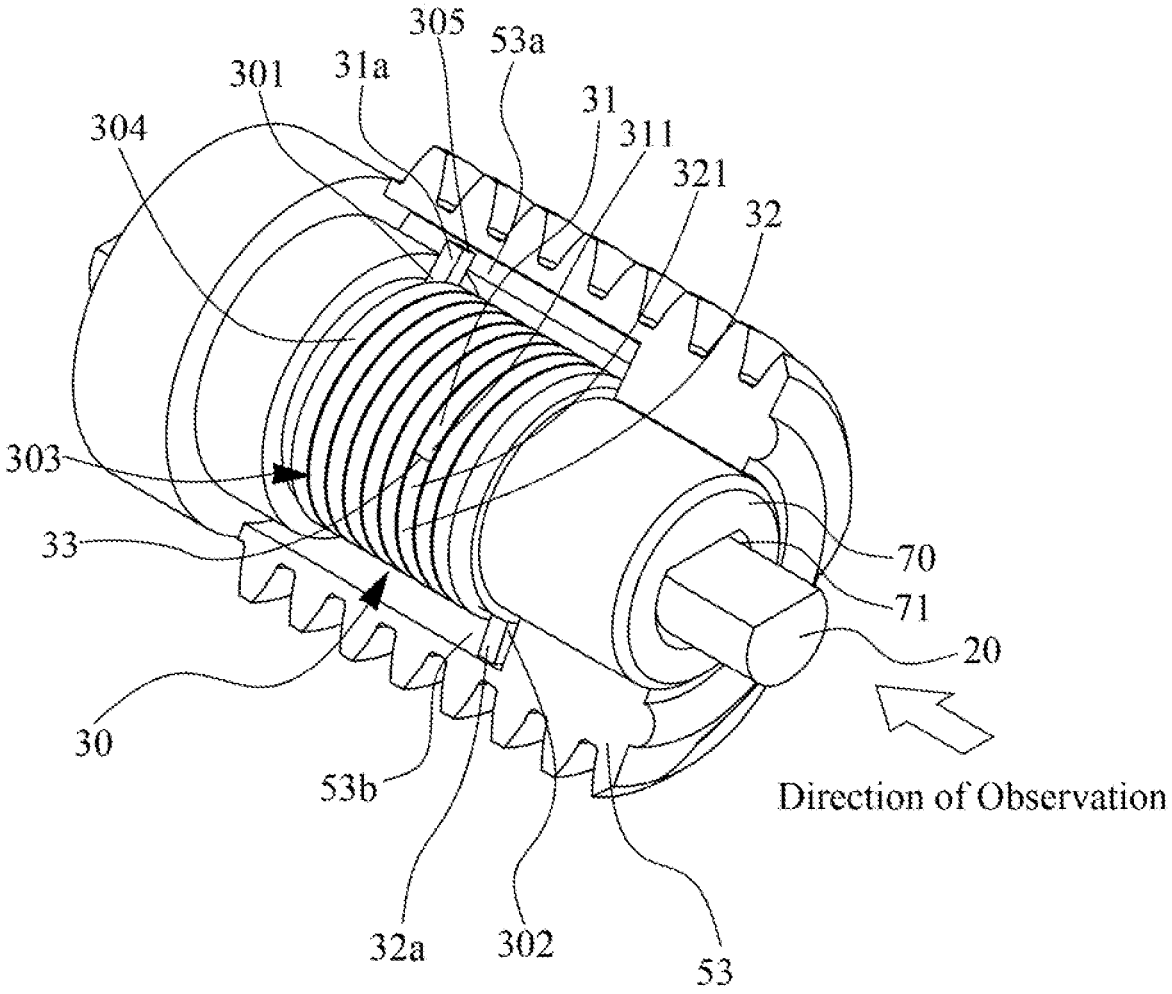
FIG. 2 is a partially cross-sectional view that shows a worm, a friction part and a fixing shaft of the resistance hinge according to the preferred embodiment of the present invention.

Referring to FIG. 1 and FIG. 2, a resistance hinge 100 in accordance with a preferred embodiment of the present invention is shown. The resistance hinge 100 includes a first hinge bracket 10, a fixing shaft 20 which is fastened in the first hinge bracket 10, a locating holder 70 surrounding the fixing shaft 20, a friction part 30 which is formed in a hollow cylinder shape and surrounds the locating holder 70 together with the fixing shaft 20, a second hinge bracket 40 pivotally mounted on the first hinge bracket 10, and a transmission module 50 which is connected between the friction part 30 and the second hinge bracket 40.

The second hinge bracket 40 is pivotally rotated around the first hinge bracket 10, so that the second hinge bracket 40 of the resistance hinge 100 is opened from the first hinge bracket 10 or closed to the first hinge bracket 10. When the second hinge bracket 40 is pivotally rotated around the first hinge bracket 10, the second hinge bracket 40 drives the friction part 30 to rotate via the transmission module 50, so when the second hinge bracket 40 rotates, the friction part 30 rubs against the locating holder 70 together with the fixing shaft 20 to provide a resistance force for the second hinge bracket 40. A middle of the locating holder 70 defines a penetrating hole 71 longitudinally penetrating through two opposite ends of the locating holder 70. The fixing shaft 20 passes through the penetrating hole 71 of the locating holder 70.

In the preferred embodiment, the transmission module 50 includes a curve rack 51, a transmission gear 52 and a worm 53. The curve rack 51 is arranged at a lower portion of one side of the second hinge bracket 40. The transmission gear 52 is pivotally mounted in the first hinge bracket 10. The transmission gear 52 is engaged with the curve rack 51. The worm 53 surrounds the locating holder 70. The worm 53 is engaged with the transmission gear 52. A driving force is transmitted between the worm 53 and the curve rack 51 by the transmission gear 52. The resistance hinge 100 further includes a transmission shaft 521. The transmission shaft 521 is transversely mounted in the first hinge bracket 10. The transmission gear 52 is hollow. A middle of the transmission gear 52 defines a through hole 522 transversely penetrating through two opposite sides of the transmission gear 52. The transmission gear 52 is mounted around the transmission shaft 521. The transmission shaft 521 passes through the through hole 522 of the transmission gear 52.

The worm 53 is a hollow shape. Two opposite ends of the worm 53 are opened freely. The worm 53 has a hollow cavity 531 longitudinally penetrating through the two opposite ends of the worm 53. The friction part 30 is mounted in the hollow cavity 531, so that the worm 53 surrounds the friction part 30. When the second hinge bracket 40 is pivotally rotated around the first hinge bracket 10, a displacement of the second hinge bracket 40 is transmitted to the transmission gear 52 through the curve rack 51, and a rotating direction and a deceleration of the second hinge bracket 40 are changed by a cooperation of the transmission gear 52 and the worm 53. Therefore, an axis direction of the friction part 30 is perpendicular to a pivot axis direction of the second hinge bracket 40, so that a width of the resistance hinge 100 is reduced. Nevertheless, when the resistance hinge 100 is operated, the transmission module 50 is often adjusted on account of a required reduction ratio, a transmission direction and other factors of the resistance hinge 100 while implementation, so the transmission module 50 is without being limited within a representation of the preferred embodiment.

Referring to FIG. 2, the friction part 30 includes a torsion spring 303. The torsion spring 303 has a spring coil 304. A tail end of the torsion spring 303 has a releasing rod 305 extending outward along a radial direction of the spring coil 304 of the torsion spring 303. The spring coil 304 of the torsion spring 303 surrounds the locating holder 70 together with the fixing shaft 20. The friction part 30 includes a first torsion spring 31 and a second torsion spring 32. The first torsion spring 31 and the second torsion spring 32 are formed by spring wires. Each of the first torsion spring 31 and the second torsion spring 32 has the spring coil 304. The spring wires of the spring coils 304 of the first torsion spring 31 and the second torsion spring 32 both surround the locating holder 70 together with the fixing shaft 20, and the first torsion spring 31 and the second torsion spring 32 in this embodiment are both left hand springs. The first torsion spring 31 and the second torsion spring 32 are longitudinally mounted around the locating holder 70 together with the fixing shaft 20 in sequence. Two sections of the first torsion spring 31 and the second torsion spring 32 abut against each other. A tail end of the first torsion spring 31 is provided with a first releasing rod 31*a* extending outward along the radial direction of the spring coil 304 of the first torsion spring 31. A tail end of the second torsion spring 32 is provided with a second releasing rod 32*a* extending outward along the radial direction of the spring coil 304 of the second torsion spring 32. Two sides of an inner surface of the worm 53 are recessed oppositely to form a first abutting groove 53*a* and a second abutting groove 53*b*. The first releasing rod 31*a* is matched with the first abutting groove 53*a*. The first releasing rod 31*a* is buckled in the first abutting groove 53*a*. The second releasing rod 32*a* is matched with the second abutting groove 53*b*. The second releasing rod 32*a* is buckled in the second abutting groove 53*b*. The torsion spring 303 is at least one of the first torsion spring 31 and the second torsion spring 32.

An inner end of the first torsion spring 31 is opposite to an outer end of the first torsion spring 31. An inner end of the second torsion spring 32 is opposite to an outer end of the second torsion spring 32. The inner end of the first torsion spring 31 is connected with the inner end of the second torsion spring 32 to form a connecting area 33. The inner end of the first torsion spring 31 is defined as a first connecting end 311, and the inner end of the second torsion spring 32 is defined as a second connecting end 321. The outer end of the first torsion spring 31 is a first extreme end 301 of the first releasing rod 31*a* of the first torsion spring 31. The outer end of the second torsion spring 32 is a second extreme end 302 of the second releasing rod 32*a* of the second torsion spring 32.

When the worm 53 rotates, a side wall of the first abutting groove 53*a* pushes against the first torsion spring 31 to make the first torsion spring 31 rotate around the locating holder 70 which is together with the fixing shaft 20, so that a friction force is generated between the first torsion spring 31, and the locating holder 70 together with the fixing shaft 20, in addition, a side wall of the second abutting groove 53*b* pushes against the second torsion spring 32 to make the second torsion spring 32 rotate around the locating holder 70 together with the fixing shaft 20, so that another friction force is generated between the second torsion spring 32, and the locating holder 70 together with the fixing shaft 20.

Referring to FIG. 2 to FIG. 5, the worm 53 pushes against the first releasing rod 31*a* and the second releasing rod 32*a* by the side wall of the first abutting groove 53*a* and the side wall of the second abutting groove 53*b*, the friction force between the first torsion spring 31, and the locating holder 70 together with the fixing shaft 20 is different from the friction force between the second torsion spring 32, and the locating holder 70 together with the fixing shaft 20 according to different rotation directions of the worm 53. Details are described as follows.

When the worm 53 rotates clockwise, the side wall of the first abutting groove 53*a* pushes against the first releasing rod 31*a* to drive the first torsion spring 31 to rotate, an interacting force transmission of the connecting area 33 is generated between the first connecting end 311 of the first torsion spring 31 and the second connecting end 321 of the second torsion spring 32, the second torsion spring 32 rotates together with the first torsion spring 31 to generate a corresponding first twisting force.

Figure 3:
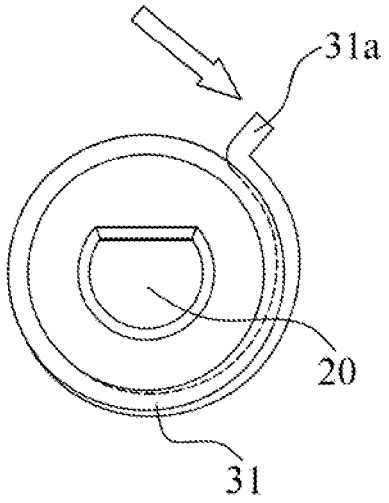
FIG. 3 is a strain diagram showing that a strain force is exerted on the friction part of the resistance hinge as observed in the observation direction indicated in FIG. 2 according to the preferred embodiment of the present invention.
Figure 4:
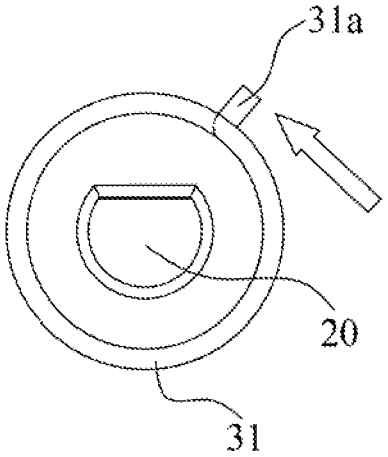
FIG. 4 is another strain diagram showing that the strain force is exerted on the friction part of the resistance hinge as observed in the observation direction indicated in FIG. 2 according to the preferred embodiment of the present invention.
Figure 5:
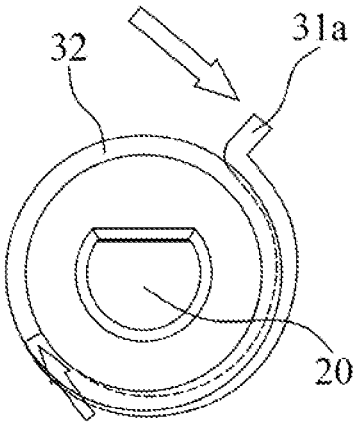
FIG. 5 is one more strain diagram showing that the strain force is exerted on the friction part of the resistance hinge as observed in the observation direction indicated in FIG. 2 according to the preferred embodiment of the present invention.
Figure 6:
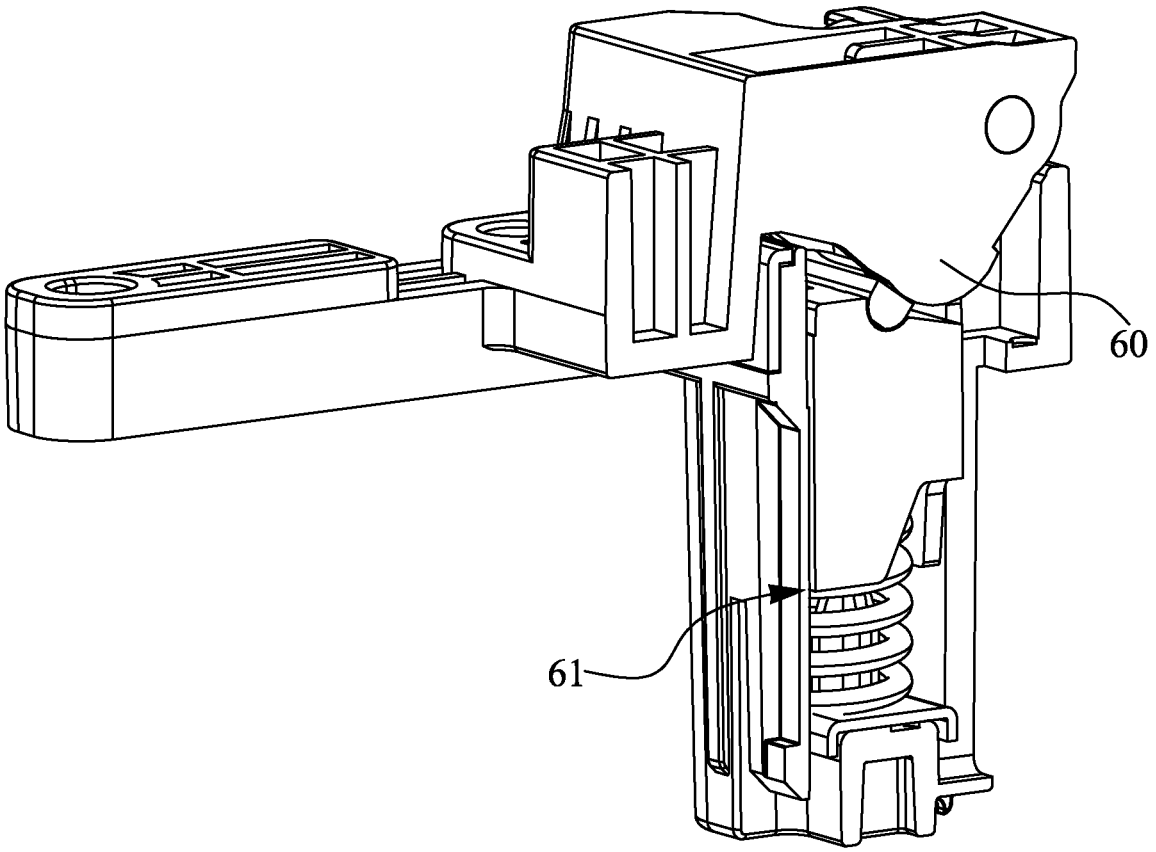
FIG. 6 (Prior Art)
FIG. 6 is a partially cross-sectional view of a conventional resistance hinge in prior art.

Referring to FIG. 3, when the worm 53 exerts a first action force on the first releasing rod 31*a* of the first torsion spring 31 from an outer end of the first torsion spring 31, the first action force is exerted on the first extreme end 301 of the first releasing rod 31*a*, and the first extreme end 301 of the first releasing rod 31*a* where the first action force is exerted, has a first distance from the spring coil 304 of the first torsion spring 31, so when the worm 53 pushes against the first extreme end 301 of the first releasing rod 31*a* to make the first torsion spring 31 rotate clockwise, the first torsion spring 31 generates a first torque to make the first torsion spring 31 rise from the locating holder 70 together with the fixing shaft 20, and the friction force between the first torsion spring 31, and the locating holder 70 together with the fixing shaft 20 is decreased. Therefore, a resistance force between the first torsion spring 31, and the locating holder 70 together with the fixing shaft 20 is reduced.

The second torsion spring 32 is pushed from the second connecting end 321 of the second torsion spring 32, the second torsion spring 32 generates a second torque to make the second torsion spring 32 move towards the locating holder 70 together with the fixing shaft 20, and a friction force between the second torsion spring 32, and the locating holder 70 together with the fixing shaft 20 is increased. Therefore, a resistance force between the second torsion spring 32, and the locating holder 70 together with the fixing shaft 20 is increased.

On the contrary, when the worm 53 rotates anticlockwise, the side wall of the second abutting groove 53*b* pushes against the second releasing rod 32*a* to drive the second torsion spring 32 to rotate, the interacting force transmission of the connecting area 33 is generated between the second connecting end 321 of the second torsion spring 32 and the first connecting end 311 of the first torsion spring 31, the first torsion spring 31 rotates together with the second torsion spring 32 to generate a corresponding second twisting force.

When the worm 53 exerts a second action force on the first releasing rod 31*a* of the first torsion spring 31 from the inner end of the first torsion spring 31, the second action force is exerted on the first connecting end 311 of the first torsion spring 31, and the first connecting end 311 of the first torsion spring 31 where the second action force is exerted, has a second distance from the spring coil 304 of the first torsion spring 31, so when the worm 53 pushes against the first connecting end 311 of the first torsion spring 31 to make the first torsion spring 31 rotate anticlockwise, the first torsion spring 31 generates a third torque to push the first torsion spring 31 to move towards the locating holder 70 together with the fixing shaft 20, and the friction force between the first torsion spring 31, and the locating holder 70 together with the fixing shaft 20 is increased. Therefore, the resistance force between the first torsion spring 31, and the locating holder 70 together with the fixing shaft 20 is increased.

The second torsion spring 32 is pushed from the second extreme end 302 of the second releasing rod 32*a* of the second torsion spring 32, the second torsion spring 32 generates a fourth torque to make the second torsion spring 32 rise from the locating holder 70 together with the fixing shaft 20, and the friction force between the second torsion spring 32, and the locating holder 70 together with the fixing shaft 20 is decreased. Therefore, the resistance force between the second torsion spring 32, and the locating holder 70 together with the fixing shaft 20 is decreased.

Referring to FIG. 2 to FIG. 5, the two sections of the spring coil 304 of the friction part 30 which are formed in the connecting area 33 between the first torsion spring 31 and the second torsion spring 32 of the friction part 30 are perpendicular to a tangent line of the spring coil 304 of the friction part 30. When the first torsion spring 31 and the second torsion spring 32 are pushed by the worm 53 to make the first torsion spring 31 and the second torsion spring 32 rotate around the locating holder 70 together with the fixing shaft 20, the first torque which makes the first torsion spring 31 rise from the locating holder 70 together with the fixing shaft 20, the second torque which makes the second torsion spring 32 move towards the locating holder 70 together with the fixing shaft 20, the third torque which pushes the first torsion spring 31 to move towards the locating holder 70 together with the fixing shaft 20, and the fourth torque which makes the second torsion spring 32 rise from the locating holder 70 together with the fixing shaft 20 are unable to pass through the two sections of the spring coil 304 of the friction part 30 which are formed in the connecting area 33 between the first torsion spring 31 and the second torsion spring 32 of the friction part 30. A tangential force of the spring coil 304 of the friction part 30 which is pushed by the worm 53 is transmitted between the two sections of the first torsion spring 31 and the second torsion spring 32.

Referring to FIG. 2, in this preferred embodiment, the two sections of the spring coil 304 of the friction part 30 which are formed in the connecting area 33 between the first torsion spring 31 and the second torsion spring 32 of the friction part 30 are perpendicular to the tangent line of the friction part 30, the first torque which makes the first torsion spring 31 rise from the locating holder 70 together with the fixing shaft 20, the second torque which makes the second torsion spring 32 move towards the locating holder 70 together with the fixing shaft 20, the third torque which pushes the first torsion spring 31 to move towards the locating holder 70 together with the fixing shaft 20, and the fourth torque which makes the second torsion spring 32 rise from the locating holder 70 together with the fixing shaft 20 are blocked.

When the worm 53 rotates clockwise, the side wall of the first abutting groove 53*a* of the worm 53 pushes against the first releasing rod 31*a* of the outer end of the first torsion spring 31 to drive the first torsion spring 31 to rotate, and the second torsion spring 32 is pushed from the inner end of the second torsion spring 32, so that the friction force between the first torsion spring 31, and the locating holder 70 together with the fixing shaft 20 is decreased, and the friction force between the second torsion spring 32, and the locating holder 70 together with the fixing shaft 20 is increased, correspondingly, the resistance force of the first torsion spring 31 is reduced, and the resistance force of the second torsion spring 32 is increased. Nevertheless, a length of the first torsion spring 31 is longer than a length of the second torsion spring 32, and the reduced resistance force of the first torsion spring 31 is larger than the increased resistance force of the second torsion spring 32, so a whole resistance force of the friction part 30 is reduced.

When the worm 53 rotates anticlockwise, the side wall of the second abutting groove 53*b* pushes against the second releasing rod 32*a* of the outer end of the second torsion spring 32 to drive the second torsion spring 32 to rotate, and the first torsion spring 31 is pushed from the inner end of the first torsion spring 31, so that the friction force between the first torsion spring 31, and the locating holder 70 together with the fixing shaft 20 is increased, and the friction force between the second torsion spring 32, and the locating holder 70 together with the fixing shaft 20 is decreased, correspondingly, the resistance force of the first torsion spring 31 is increased, and the resistance force of the second torsion spring 32 is decreased. Nevertheless, the length of the first torsion spring 31 is longer than the length of the second torsion spring 32, and the increased resistance force of the first torsion spring 31 is larger than the decreased resistance force of the second torsion spring 32, so the whole resistance force of the friction part 30 is increased.

Therefore, when the second hinge bracket 40 of the resistance hinge 100 is opened from the first hinge bracket 10 or closed to the first hinge bracket 10, a length proportion of the first torsion spring 31 and a length proportion of the second torsion spring 32 of the friction part 30 are adjusted, so the whole resistance force of the friction part 30 provided for the second hinge bracket 40 is adjusted under a condition of unchanging other components of the resistance hinge 100, the whole resistance force of the friction part 30 provided for the second hinge bracket 40 is adjusted by virtue of adjusting the length of the first torsion spring 31 and the length of the second torsion spring 32, correspondingly, the whole resistance force of the friction part 30 provided for the second hinge bracket 40 is adjusted by virtue of adjusting the length proportion of the first torsion spring 31 and the length proportion of the second torsion spring 32 of the friction part 30.

As described above, when the second hinge bracket 40 of the resistance hinge 100 is opened from the first hinge bracket 10 or closed to the first hinge bracket 10, the whole resistance force of the friction part 30 provided for the second hinge bracket 40 is adjusted by virtue of adjusting the length proportion of the first torsion spring 31 and the length proportion of the second torsion spring 32 of the friction part 30. As a result, the resistance hinge 100 has a stable resistance force, and the resistance force of the resistance hinge 100 is adjusted easily.

What is claimed is:

1. A resistance hinge, comprising:

a first hinge bracket;

a fixing shaft fastened in the first hinge bracket;

a locating holder surrounding the fixing shaft;

a friction part formed in a hollow cylinder shape and surrounding the locating holder together with the fixing shaft;

a second hinge bracket pivotally mounted on the first hinge bracket; and a transmission module connected between the friction part and the second hinge bracket;

wherein the friction part includes a torsion spring, the torsion spring has a spring coil, a tail end of the torsion spring has a releasing rod extending outward along a radial direction of the spring coil of the torsion spring, the spring coil of the torsion spring surrounds the locating holder together with the fixing shaft.

2. The resistance hinge as claimed in claim 1, wherein the transmission module includes a curve rack, a transmission gear and a worm, the curve rack is arranged at a lower portion of one side of the second hinge bracket, the transmission gear is pivotally mounted in the first hinge bracket, the transmission gear is engaged with the curve rack, the worm surrounds the locating holder, the worm is engaged with the transmission gear.

3. The resistance hinge as claimed in claim 2, wherein the worm has a hollow cavity longitudinally penetrating through the two opposite ends of the worm, the friction part is mounted in the hollow cavity.

4. The resistance hinge as claimed in claim 2, wherein the resistance hinge further includes a transmission shaft, the transmission shaft is transversely mounted in the first hinge bracket, a middle of the transmission gear defines a through hole transversely penetrating through two opposite sides of the transmission gear, the transmission gear is mounted around the transmission shaft, the transmission shaft passes through the through hole of the transmission gear.

5. The resistance hinge as claimed in claim 1, wherein a middle of the locating holder defines a penetrating hole longitudinally penetrating through two opposite ends of the locating holder, the fixing shaft passes through the penetrating hole of the locating holder.

6. A resistance hinge, comprising:

a first hinge bracket;

a fixing shaft fastened in the first hinge bracket;

a locating holder surrounding the fixing shaft;

a friction part formed in a hollow cylinder shape and surrounding the locating holder together with the fixing shaft;

a second hinge bracket pivotally mounted on the first hinge bracket; and a transmission module connected between the friction part and the second hinge bracket;

wherein the friction part includes a first torsion spring and a second torsion spring, the first torsion spring and the second torsion spring are formed by spring wires, each of the first torsion spring and the second torsion spring has a spring coil, the spring wires of the spring coils of the first torsion spring and the second torsion spring both surround the locating holder together with the fixing shaft, and the first torsion spring and the second torsion spring have the same twisting direction.

7. The resistance hinge as claimed in claim 6, wherein a tail end of the first torsion spring is provided with a first releasing rod extending outward along a radial direction of the spring coil of the first torsion spring, a tail end of the second torsion spring is provided with a second releasing rod extending outward along the radial direction of the spring coil of the second torsion spring, the transmission module includes a worm, the worm is a hollow shape, two opposite ends of the worm are opened freely, two sides of an inner surface of the worm are recessed oppositely to form a first abutting groove and a second abutting groove, the first releasing rod is matched with the first abutting groove, the first releasing rod is buckled in the first abutting groove, the second releasing rod is matched with the second abutting groove, the second releasing rod is buckled in the second abutting groove.

8. The resistance hinge as claimed in claim 6, wherein the first torsion spring and the second torsion spring are longitudinally mounted around the locating holder together with the fixing shaft in sequence, two sections of the first torsion spring and the second torsion spring abut against each other.

9. The resistance hinge as claimed in claim 6, wherein two sections of the spring coil of the friction part which are formed in a connecting area between the first torsion spring and the second torsion spring of the friction part are perpendicular to a tangent line of the spring coil of the friction part, a first torque which makes the first torsion spring rise from the locating holder together with the fixing shaft, a second torque which makes the second torsion spring move towards the locating holder together with the fixing shaft, a third torque which pushes the first torsion spring to move towards the locating holder together with the fixing shaft, and a fourth torque which makes the second torsion spring rise from the locating holder together with the fixing shaft are blocked.

10. The resistance hinge as claimed in claim 6, wherein when the second hinge bracket of the resistance hinge is opened from the first hinge bracket or closed to the first hinge bracket, a whole resistance force of the friction part provided for the second hinge bracket is adjusted by virtue of adjusting a length of the first torsion spring and a length of the second torsion spring.

11. A resistance hinge, comprising:

a first hinge bracket;

a fixing shaft fastened in the first hinge bracket;

a locating holder surrounding the fixing shaft;

a friction part formed in a hollow cylinder shape and surrounding the locating holder together with the fixing shaft;

a second hinge bracket pivotally mounted on the first hinge bracket;

a transmission module connected between the friction part and the second hinge bracket, the transmission module including a curve rack, a transmission gear and a worm, the curve rack being arranged at a lower portion of one side of the second hinge bracket, the transmission gear being hollow, the transmission gear being pivotally mounted in the first hinge bracket, the transmission gear being engaged with the curve rack, the worm surrounding the locating holder, the worm being engaged with the transmission gear; and a transmission shaft, the transmission gear being mounted around the transmission shaft.

12. A resistance hinge, comprising:

a first hinge bracket;

a fixing shaft fastened in the first hinge bracket;

a locating holder surrounding the fixing shaft;

a friction part including a first torsion spring and a second torsion spring, the first torsion spring and the second torsion spring both surrounding the locating holder together with the fixing shaft;

a second hinge bracket pivotally mounted on the first hinge bracket;

a transmission module connected between the friction part and the second hinge bracket, the transmission module including a curve rack, a transmission gear and a worm, the curve rack being arranged at a lower portion of one side of the second hinge bracket, the transmission gear being hollow, the transmission gear being pivotally mounted in the first hinge bracket, the transmission gear being engaged with the curve rack, the worm surrounding the locating holder, the worm being engaged with the transmission gear; and a transmission shaft, the transmission gear being mounted around the transmission shaft.

* * * * *